United States Patent [19]

Weisz

[11] Patent Number: 4,612,821

[45] Date of Patent: Sep. 23, 1986

[54] SPRING SYSTEM FOR PUSH-BUTTON CONTROL IN A SEWING MACHINE

[75] Inventor: William Weisz, Tenafly, N.J.

[73] Assignee: The Singer Company, Stamford, Conn.

[21] Appl. No.: 461,827

[22] Filed: Jan. 28, 1983

[51] Int. Cl.[4] ..... G05G 11/00

[52] U.S. Cl. ..... 74/483 PB; 112/466; 112/463

[58] Field of Search ..... 74/483 PB; 200/5 B, 200/5 E, 5 EA, 5 EB, 50 C, 340; 112/158 A, 158 B, 158 C, 158 D

[56] References Cited

U.S. PATENT DOCUMENTS

| | | | |
|---|---|---|---|
| 2,634,340 | 4/1953 | Batcheller | 74/483 PB |
| 3,156,205 | 11/1964 | Reeber et al. | 112/158 |
| 3,217,677 | 11/1965 | Eguchi | 112/158 |
| 3,254,618 | 6/1966 | Eguchi | 112/158 C |
| 3,279,402 | 10/1966 | Eguchi | 112/158 D |
| 3,332,380 | 7/1967 | Yanagibayashi | 112/158 |
| 3,351,051 | 12/1967 | Eguchi | 112/158 D |
| 4,297,956 | 11/1981 | Meier | 112/158 A |
| 4,441,440 | 4/1984 | Weisz | 112/158 C |
| 4,442,784 | 4/1984 | Weisz et al. | 112/158 C |
| 4,453,478 | 6/1984 | Weisz | 112/158 D X |

FOREIGN PATENT DOCUMENTS

| | | | |
|---|---|---|---|
| 604159 | 8/1960 | Canada | 74/483 PB |
| 588900 | 10/1964 | Japan . | |
| 54-163151 | 6/1978 | Japan . | |
| 56-145480 | 3/1980 | Japan . | |

*Primary Examiner*—William F. Pate, III
*Assistant Examiner*—Dwight G. Diehl
*Attorney, Agent, or Firm*—William V. Ebs; Robert E. Smith; Edward L. Bell

[57] ABSTRACT

A push-button control for a sewing machine is provided with a spring system which returns slidable push-buttons from actuated to unactuated positions, and includes individual wire springs supported within grooves in a fixed member and preloaded against extended portions of the buttons.

5 Claims, 3 Drawing Figures

SPRING SYSTEM FOR PUSH-BUTTON CONTROL IN A SEWING MACHINE

DESCRIPTION

BACKGROUND OF THE INVENTION

1. Field of the Invention

The invention relates to push-button controls for sewing machines and, more particularly, to spring systems for use therein.

2. Description of the Prior Art

It is well known to provide a push-button control on a sewing machine with a spring system for use in returning slidable push-buttons from actuated to unactuated positions. However, space limitations have tended to compromise the design of such systems and result in unsatisfactory arrangements. It is essential that a spring system be capable of being accommodated in the available space, that individual springs be arranged and supported in defined positions for coaction with the slidable push-buttons, and that overstressing resulting in permanent deformation of the springs be prevented. It may also be necessary to have certain springs stiffer than others so as to require an operator to use more force to depress particular buttons.

It is a prime object of the present invention to provide a push-button control for a sewing machine with an improved spring system which efficiently utilizes space in the machine, which prevents the overstressing of springs, and in which springs are effectively maintained in defined positions for coaction with slidable push-buttons.

It is another object of the invention to provide a push-button control for a sewing machine with an improved spring system which can be easily assembled with readily manufactured parts, including individual springs preselected for use according to the stiffness desired for each.

Other objects and advantages of the invention will become apparent during a reading of the specification taken in connection with the accompanying drawings.

SUMMARY OF THE INVENTION

A push-button control for a sewing machine is provided with a spring system for returning slidable push-buttons from actuated to unactuated positions. The spring system includes a fixed member and individual wire springs, which are supported in spaced apart grooves in the fixed member and extend therefrom in a direction transverse with respect to the direction of movement of the push-buttons. Free ends of the spring are preloaded against extended portions of the push-buttons while the push-buttons are in unactuated positions. The wire springs elastically snap into the grooves in the fixed member and so provide an assembly which can be installed as a unit in a control module. Springs with different spring rates may be selected for the assembly as desired.

DESCRIPTION OF THE PREFERRED EMBODIMENT

Figure 1:
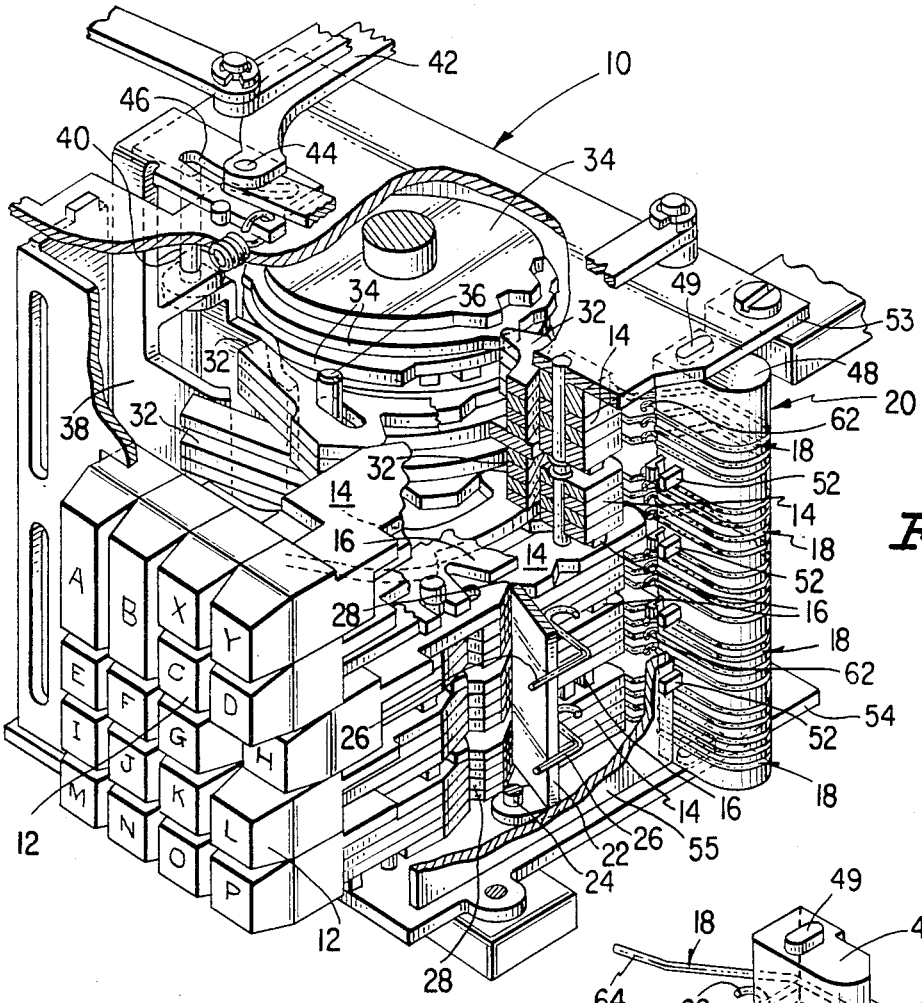
FIG. 1 is a perspective view of a push-button sewing machine control module which has been broken away to show a spring system according to the invention incorporated therein.

Referring to FIG. 1 of the drawings reference character 10 designates a sewing machine push-button control module of the kind shown, for example, in the copending patent application of William Weisz for "Push-Button Control Module for a Sewing Machine", Ser. No. 449,721, filed Dec. 14, 1982 now U.S. Pat. No. 4,441,440. As shown, the module includes multiple push-buttons 12. Portions 14, of the various buttons, extend rearwardly and terminate in a vertical column. The push-button extensions 14 are vertically stacked between separating plates 16 for relative sliding motion and are movable between actuated and unactuated positions. The push-buttons are movable into actuated positions against the bias of the springs 18, of a spring assembly 20, and are movable by the springs 18 into the unactuated positions.

A plate 22, pivoted in the module at 24 and biased by a spring 26 against the push-button extensions 14, enters a groove 28, in each push-button extension 14, to hold the push-button in an actuated position, and enters a groove 30 in the extension to hold the push-button in an unactuated condition. Whenever one push-button is actuated by being pushed rearwardly, plate 22 is pivoted to release any previously actuated push-button for movement by its associated spring 18 into an unactuated position. In the actuated position of each push-button, a slidable cam follower 32 is held by the push-button extension in position for actuation by a cam 34 as described in the aforesaid patent application of William Weisz. The follower is rocked, on a shaft 36, according to the contour of the cam and the follower in turn is caused to impart pivotal movement to a wobble plate 38 mounted on a shaft 40. Bight controlling mechanism including a link 42, which is pin connected at 44 to the wobble plate in a slot 46, is operated according to the movement of the wobble plate.

Figure 2:
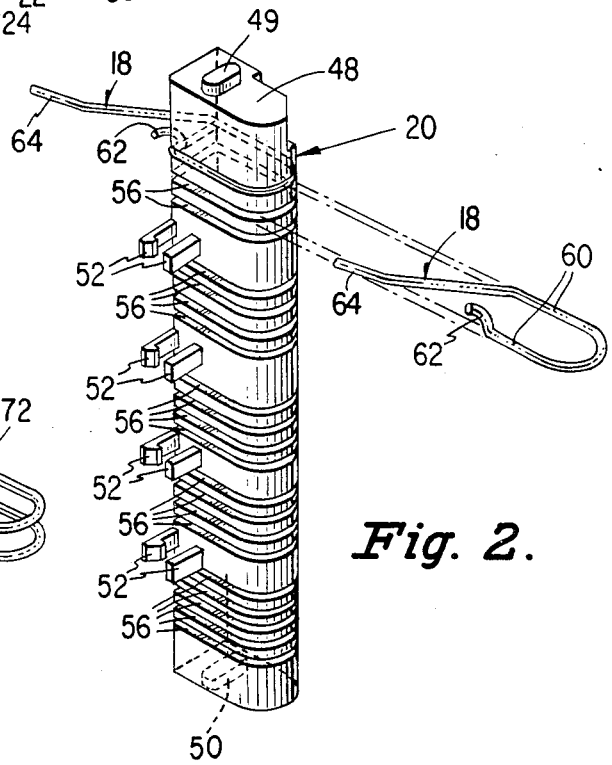
FIG. 2 is an enlarged perspective view showing parts of a spring assembly according to the invention.

Spring assembly 20 (see FIGS. 1 and 2) includes a post 48 which is formed with end tabs 49 and 50, and with transversely extending fingers 52. The post is secured in module 10 by having the end tabs 49 and 50 extend through upper and lower plates 53 and 54 respectively of the module, and having fingers 52 bracket side plate 55 of the module. The post is formed with spaced apart grooves 56 and carries a wire spring 18 in each groove. The springs are formed with a looped portion 60, which can be resiliently snapped into the grooves in the post, and with a hooked end 62 to prevent the springs from sliding in the grooves after having been assembled onto the post. Each of the springs extends from the post in a direction transverse with respect to the direction of movement of the push-button extensions to bring a free end 64 into engagement with an extension as in an end slot which may be provided therein. The springs are preloaded against the push-button extensions in the unactuated positions of the button. When a push-button is moved to an actuated position by being depressed the engaging spring is deflected increasing stress in the spring. However, elastic deformation energy is distributed over the entire length of the spring including the portion within the groove 56 in post 48, and overstressing of the spring (that is beyond its elastic limit) at any particular point is prevented. The elastic energy stored in a spring when a push-button is depressed serves to return the engaged push-button when released to its unactuated position in module 10. The springs may all be equally stiff, or certain of the springs may have spring rates to render them more or less stiff than others as deemed desirable for the force needed to depress particular push-buttons.

Figure 3:
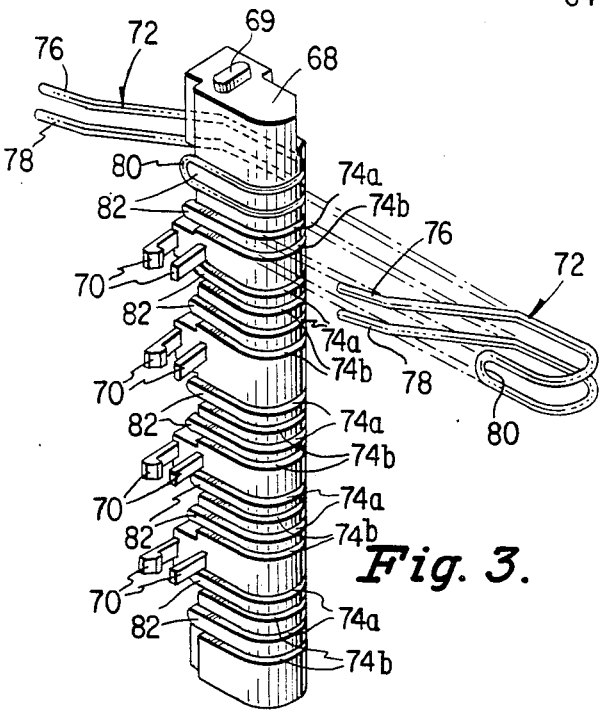
FIG. 3 is an enlarged perspective view showing parts of a modified spring assembly according to the invention.

A modified form of spring assembly according to the invention (see FIG. 3) includes a post 68, and springs 72 supported on the post in multiple pairs of adjacent grooves 74*a* and 74*b*. Each spring is formed from a single piece of wire, but has two free ends 76 and 78, each of which may engage a different push-button extension. Each spring is retained in a pair of adjacent grooves 74*a* and 74*b*, and has a cross end portion 80, which hooks about a band 82 on the post, to prevent the spring from sliding on the post. The springs snap into the grooves in the post and are therefor easily assembled with the post into a unit easily installed in a control module. The post is formed with end tabs as shown for example at 69, and with fingers 70 to facilitate attachment of the unit to the module.

It is to be understood that the present disclosure relates to a preferred embodiment of the invention which is for the purposes of illustration only, and is not to be construed as a limitation of the invention. Numerous alterations and modifications will suggest themselves to those skilled in the art, and all such modifications which do not depart from the spirit and scope of the invention are intended to be included within the scope of the appended claims.

I claim:

1. In a push-button control module, a plurality of slidable push-buttons which are movable by an operator from unactuated to actuated positions, said push-buttons including rearwardly extending portions terminating in a vertical column; and a spring assembly for use in moving the push-buttons from the actuated to unactuated positions, the assembly including a plurality of wire springs, and a fixed upright member wherein there a plurality of transversely extending longitudinally spaced grooves in which the wire springs are retained and from which the springs extend transversely with respect to the directions of movement of the push-button extensions to bring free ends of the spring into engagement with the extensions, the springs being individually preloaded against the extensions in the unactuated positions of the push-buttons.

2. The combination of claim 1 wherein the wire springs are formed to elastically snap into the grooves in the fixed upright member.

3. The combination of claim 1 wherein each spring engages one extension.

4. The combination of claim 1 wherein each spring includes multiple free ends for individually engaging different push-button extensions.

5. The combination of claim 1 wherein different ones of the springs have different spring rates.

* * * * *